US006253851B1

(12) United States Patent
Schroeder, Jr. et al.

(10) Patent No.: US 6,253,851 B1
(45) Date of Patent: Jul. 3, 2001

(54) METHOD OF COMPLETING A WELL

(75) Inventors: Donald E. Schroeder, Jr., Littleton; Philip H. Winterfeld, Englewood, both of CO (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 09/399,135

(22) Filed: Sep. 20, 1999

(51) Int. Cl.[7] ..... E21B 43/04; E21B 43/267
(52) U.S. Cl. ..... 166/278; 166/51; 166/280
(58) Field of Search ..... 166/51, 205, 276, 166/278, 280, 281, 296

(56) References Cited

U.S. PATENT DOCUMENTS

| | | | | |
|---|---|---|---|---|
| 2,978,024 | * | 4/1961 | Davis | 166/51 X |
| 4,416,331 | | 11/1983 | Lilly | 166/236 |
| 4,424,864 | | 1/1984 | Logan | 166/278 |
| 4,510,996 | | 4/1985 | Hardin | 166/227 |
| 4,685,519 | | 8/1987 | Stowe et al. | 166/278 |
| 4,917,188 | * | 4/1990 | Fitzpatrick, Jr. | 166/278 X |
| 4,932,474 | * | 6/1990 | Schroeder, Jr. et al. | 166/278 |
| 5,062,484 | | 11/1991 | Schroeder, Jr. et al. | 166/278 |
| 5,127,474 | | 7/1992 | Schroeder, Jr. et al. | 155/278 |
| 5,165,476 | * | 11/1992 | Jones | 166/278 |
| 5,269,375 | | 12/1993 | Schroeder, Jr. | 166/278 |
| 5,417,284 | * | 5/1995 | Jones | 166/280 |
| 5,435,391 | * | 7/1995 | Jones | 166/278 X |
| 5,443,117 | * | 8/1995 | Ross | 166/51 |
| 5,690,175 | * | 11/1997 | Jones | 166/278 |
| 5,848,645 | * | 12/1998 | Jones | 166/280 |
| 5,890,533 | * | 4/1999 | Jones | 166/51 |

OTHER PUBLICATIONS

"Remedial Cleanup, Sand Control and Other Stimulation Treatments," by A. W.. Coulter, Jr., S. J. Martinez, and K. F. Fischer, *Petroleum Engineering Handbook*, Howard B. Bradley, Editor–in–Chief, Chapter 56, pp. 56–1 and 56–8, (1987).

"Sand Control," by robert M. Pearson, IHRDC Video Library for Exploration and Production Specialists, PE306 Petroleum Engineering, p. 97, (1988).

"Frac Packs Justify Extra Up–Front Cost," by Brian Stewart, *The American Oil & Gas Reporter*, vol. 41, No. 2, pp. 96–101, (Feb. 1998).

"Frac Packs: A Specialty Option or Primary Completion Technique?," *Hart's Petroleum Engineer International*, vol. 70, No. 3 (suppl), pp. 12–15 (Mar. 1997).

"Frac Packs—State of the Art," by Robert L. Tiner, John W. Ely, and Richard Schraufnagel, Annu. SPE Tech. Conf. (Denver Oct. 6–9, 1996), pp. 381–390, (SPE–36456; 45 refs).

"Fracturing, Frac–Packing and Formation Failure Control: Can Screenless Completions Prevent Sand Production?," by Nobuo Morita, Bob Burton, and Eric Davis, Annu. SPE Tech. Conf. (Denver Oct. 6–9, 1996), pp. 391–402, 1996 (SPE–36457; 5 refs).

"Frac and Pack Stimulation: Application, Design, and Field Experience From the Gulf of Mexico to Borneo," by L. P. Roodhart, P. A. Fokker, D. R. Davies, Jacob Shlyapobersky, and G. K Wong, 68$^{th}$ Annual SPE Tech. Conf. (Houston Oct. 3–6, 1993), pp. 507–518, 1993 (SPE–26564; 13 refs).

* cited by examiner

*Primary Examiner*—George Suchfield
(74) *Attorney, Agent, or Firm*—Jack E. Ebel

(57) ABSTRACT

This invention relates to a method of completing a well that penetrates a subterranean formation and more particularly to a method for screen placement during proppant packing of formation perforations or fractures created by hydraulic fracturing techniques. The top of the screen is placed at a sufficient distance below the top of the perforations such that the frac pack pumping rate does not bridge off at the top of the screen when the frac pack is being pumped.

10 Claims, 1 Drawing Sheet

METHOD OF COMPLETING A WELL

BACKGROUND OF THE INVENTION

1. Field of the Invention

The present invention relates to a method of completing a well that penetrates a subterranean formation and more particularly to a method for screen placement during proppant packing of formation fractures to prevent premature bridging of the proppant.

2. Description of Related Art

A long-standing dilemma in the petroleum industry is the production of unconsolidated materials, e.g., sand and other fines, from unconsolidated hydrocarbon-bearing formations. Erosion of production equipment, well plugging, and reduced production levels or loss of well production are some of the consequences of this problem if left unaddressed.

Gravel packing is commonly used to reduce the amount of unconsolidated materials produced along with hydrocarbons. Slotted or screened liners are used during gravel packing to prevent the sand and other fines from being transported by produced hydrocarbons into the well bore. Consolidating plastic material may also be used to cement the grains together to provide formation stability while maintaining permeability.

In addition to gravel packing, frac packing includes hydraulic fracturing wherein the unconsolidated formation is fractured and propping material is deposited in the fracture. The two step method of frac packing in its simplest form involves 1) hydraulic fracturing of the formation, i.e., injecting a fracturing fluid down a well at sufficiently high pressure to propagate a fracture into the subterranean formation; and 2) incorporating proppant materials within the fracturing fluid and injecting and depositing the proppant in the fracture(s).

The proppant is commonly mixed with a fluid, such as a liquid or foam, to form a slurry of the proppant which is then introduced through a work string and a crossover tool into the annulus between the well bore and the liner. The slurry is pumped down the annulus to the bottom of the well bore or to a sump packer in the well bore. The bulk of the slurry fluid flows into the subterranean zone through perforations in the wellbore. Proppant is thus deposited in the annulus and against the subterranean zone. Some of the fluid of the slurry can be allowed to flow through the apertures in the liner into the open bottom end of a wash pipe situated within the liner and return to the surface through the crossover tool and the annulus between the work string and the well casing.

Despite the effectiveness of fracture proppant packs, once the screened liner is properly placed, it is often difficult to install a uniform proppant pack in a frac pack operation due to the problem of premature bridging as the proppant laden fluid is being pumped. Premature bridging occurs when the upstream perforations, that is, the perforations first encountered by the proppant laden fluid, fill with proppant from the proppant slurry and form deposits or bridging which impede the flow of the slurry down the annulus. When this occurs, the slurry follows the path of less resistance, which in this case is through the screen. This in turn accelerates the bridging action, as flow of the slurry fluid through the screen deposits proppant on the upper most portion of the screen. While bridging in this manner can occur in a vertical well, the problem is more severe in a deviated well, where proppant transport through the horizontal well bore annulus is more difficult because it is not assisted by gravity.

U.S. Pat. No. 5,062,484 teaches a method of preventing bridging when gravel packing a well in fluid communication with a subterranean formation by sealing the upper apertures of a gravel pack liner against entry of a slurry fluid. This prevents gravel from clogging the apertures or bridging the annulus between the liner and the well bore. An immobile gel provides the sealing function and a breaker, which can be incorporated into the gel, eventually breaks the gel thereby permitting removal of the gel and unblocking the apertures.

It is an object of this invention to provide a method to prevent premature bridging in hydraulic fracture packing operations in a manner which does not impair or slow the proppant placement process.

It is another object of the present invention to provide a method for gravel packing and/or frac packing a subterranean well which results in the formation of a substantially uniform gravel pack over substantially the entire length of the area to be packed.

Another object of the present invention is to provide a method for gravel packing and/or frac packing a subterranean well which is economical, efficient and which is operable in vertical or deviated wells.

SUMMARY OF THE INVENTION

To achieve the foregoing and other objectives of the invention, and in accordance with the purposes of the present invention, as embodied and described herein, the screen during the packing is placed at a sufficient distance below the top perforations of the well so that the frac pack fluids have an alternate path past the screen to casing bridge that may form. The alternate path is through the perforations above the screen into the formation and back to the lower perforated well casing, effectively bypassing any potential proppant bridge in the annulus between the screen the perforated casing. The flow of frac pack fluids through the perforations above the screen also reduces the flow velocity near the top of the screen sufficiently to prevent bridge off at the top of the screen. The number and diameter of perforations, the flow rate of the frac pack and flow properties of the frac pack will influence the distance between the top perforations and the top of the screen.

Another characterization of the present invention comprises an improved method of gravel packing a well without experiencing bridging of the packing at the top portion of the screen.

BRIEF DESCRIPTION OF THE DRAWINGS

The accompanying drawing, which is incorporated in and forms a part of the specification, illustrates the embodiments of the present invention and, together with the description, serves to explain the principles of the invention.

DESCRIPTION OF THE PREFERRED EMBODIMENTS

Figure 1:
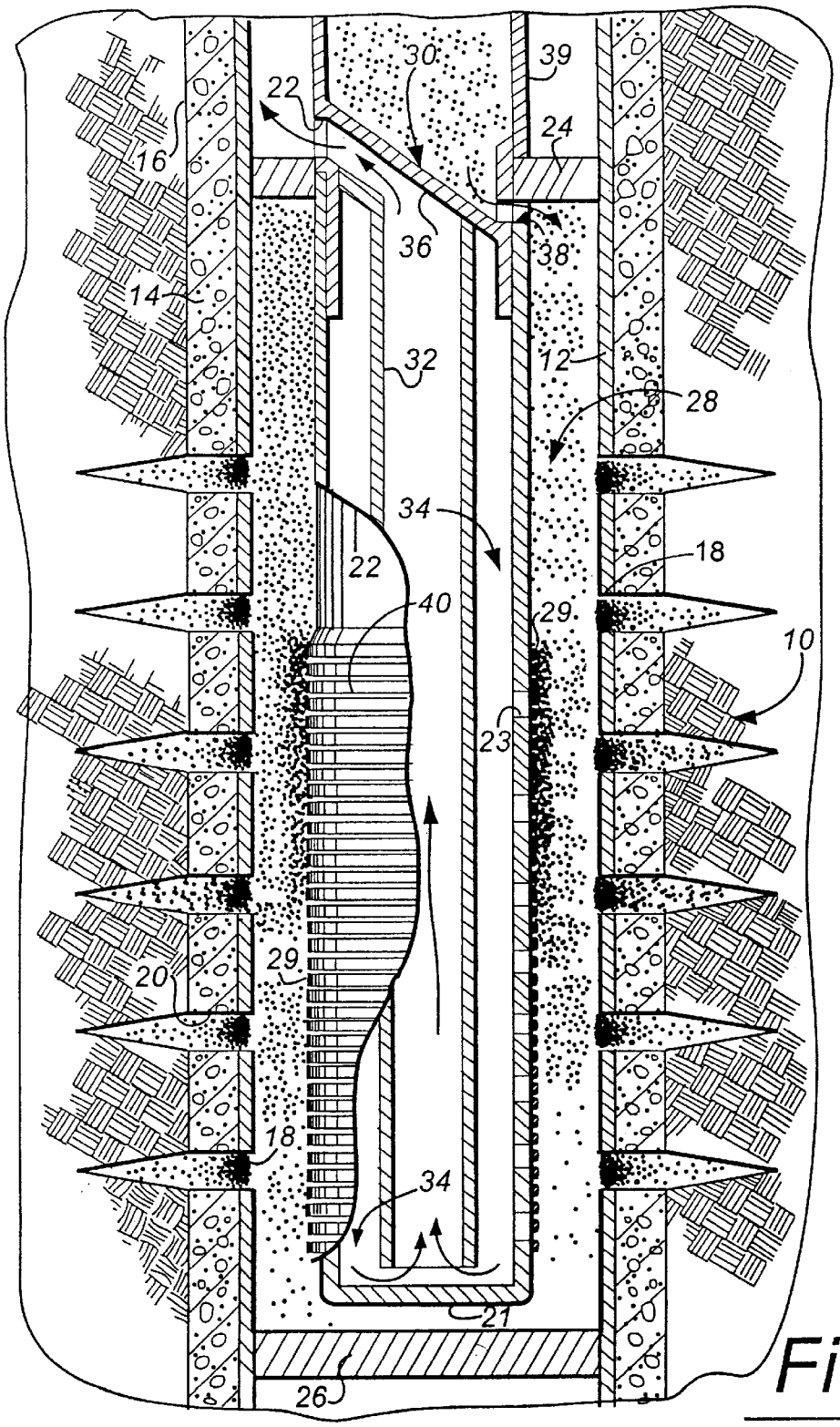
FIG. 1 is a simplified partial longitudinal sectional view of a well undergoing the packing step of a frac packing operation in accordance with the method of the present invention.

This invention is applicable to completing wells that penetrate subterranean formations, especially those subterranean formations which are hydrocarbon-bearing. It is especially applicable to screen placement during proppant packing of formation fractures or perforations created in the formation.

Referring to FIG. 1, a typical oil or gas well which penetrates a subterranean formation 10 comprises a casing 12 cemented to the well bore 16. The casing and cement 14 contain perforations 18 and 20 (for brevity and for purposes of this invention, perforations also refer to fractures), respectively, through which fluid (in production) is intended to flow from formation 10 into casing 12. Perforations 18 and 20 may be formed in any conventional manner, such as by use of a perforating gun, as will be evident to a skilled artisan. Although a cased well has been shown for purpose of illustration, it will be understood that the invention can also readily be used in connection with an uncased well. Therefore, the term "wellbore" as used herein refers to the area inside a cased or an uncased well. Although the invention normally is utilized in connection with a well for producing fluid from a subterranean formation, those skilled in the art will recognize that it may also be employed in connection with a well used to inject fluid into a subterranean formation.

A tubular liner 22 containing apertures 23 is run into the hole in accordance with conventional methods and extends from a packer 24 down to a point spaced a short distance from a packer 26, which may be either a sump packer or a packer separating zones in a multiple completion. Alternatively, liner 22 may extend down to a point spaced a short distance from the bottom of the well bore instead of to an intermediate packer if the production formation were adjacent the bottom of the wellbore. The top of the apertures 23 is below the top of the upper most perforations 18 and 20. Liner 22, which is spaced from casing 12 to create annulus 28, is illustrated as being covered by screen 29. If employed, screen 29 may be of any known prior art design, conventionally being formed so that the screen openings 40 are of smaller size than the apertures 23. If a screen is not employed, the liner would contain apertures typically in the nature of slits, the greatest dimension of which would preferably be smaller than the size of the gravel used in a gravel packing operation.

A cross-over tool 30 is also supported by packer 24 and includes wash pipe 32 which is spaced from the liner 22 to define annulus 34. The bottom of wash pipe 32 is spaced from the bottom wall 21 of liner 22 to allow fluid to enter the wash pipe from within the liner. Cross-over tool 30 includes diverter means 36 for directing a gravel slurry through ports 38 in liner 22 to cause the slurry to enter the annulus 28 and to allow carrier fluid to flow from wash pipe 32 to the surface. The apertures 23 in liner 22 permit the flow of production fluid through the liner during production operations, or gravel pack and other fluids during the completion operations.

In accordance with the present invention as illustrated in FIG. 1, the top of screen 29, or if a screen is not employed, the uppermost aperture 23 in liner 22 is positioned below the uppermost perforations 18 and 20 in casing 12. A fluid mixture or slurry of frac packing material is shown moving through the work string 39 and ports 38 into annulus 28 either after an initial portion of the frac packing material has been placed in the fractures through the perforations or with an initial portion of the frac packing material. The overbalance pressure at the perforated interval, which is the amount of pressure in the well bore from the hydrostatic head that exceeds the reservoir pressure, causes the fluid to flow through the perforations 18 and 20, screen openings 40 and the apertures 23 in the liner 22 at such a rate to deposit the frac packing material in the perforations 18 and 20, on the screen 29 covering the liner and in the formation adjoining the perforations. By knowing the dimensions of the annular space to be packed, the concentration of flow-reducing material in the carrier fluid and the rate of flow of the slurry, the length of time that the slurry should be pumped into the annulus can readily be calculated by those skilled in the art. As stated above, the invention is applicable to deviated wellbores, the frac packing operation would proceed in the same manner as described above or the formation may be fractured and then the annulus packed using a screen.

The screen should be placed at a sufficient distance below the top of the perforations such that the frac pack pumping rate does not bridge off at the top of the screen during frac packing. The number for perforations, diameter of the perforations, flow rate of the frac pack and the flow properties of the frac pack also influence the distance. For example, if the perforations per foot and the diameter of the perforations are small, the distance will be greater or on the high side of the below ranges. For typical perforations, i.e., within the range of about 8 to 16 shots per foot, and for pump rates for the frac pack of about 10 to 25 bpm (barrels per minute), the distance between the top of the perforations and the top of the screen can be about ½ to about 15 feet, preferably about 1 to about 8 feet and most preferably about 2 to about 6 feet. However, the pump rates can be as low as 1 and as high as 75 bpm, dependant on the depth of the formation, the formation, the number of perforations, fluidity of the frac pack, etc. In addition, the density and diameter of the perforations can be as low as 2 and as high as 20 shots per foot and from about 0.25 to about 1.0 inches in diameter, respectively. Preferably, the pump rates are about 2 to about 50 bpm and more preferably about 5 to about 40 bpm.

Various frac packing materials may be employed as desired, as long as they are capable of performing in the manner described above. The frac pack fluids can be designed to reduce formation damage and other desired effects.

EXAMPLE

The following example demonstrates the practice and utility of the invention. This example is not to be construed as limiting the scope thereof.

The following conditions are the base case conditions to simulate gravel packing, using "PACGR" simulation software originated by Marathon Oil Company, 7400 South Broadway, Littleton, Colo., and the tendency for bridging to occur in a screen/perforated casing annulus:

The perforation interval is 62 feet; the hole size is 6 inches; the casing specifications are 5 inches, 4.276 internal diameter, 18 pounds per foot, P-110; the hole angle across the zone is 58 degrees; the perforations consist of 12 shots per foot, except the bottom thirty feet of the interval consists of 18 shots per foot; the diameter of each perforation is 0.56 inches; the bottom hole pressure (bhp) is 4,200 pounds per square inch gauge (psig); the porosity of the target interval is 26%; the permeability of the target interval varies: beginning with 50 milidarcies (md) from 13,806 to 13,813 feet; 300 md from 13,813 to 13,816 feet; 50 md from 13,816 to 13,820 feet; 500 md from 13,820 to 13,824 feet; 50 md from 13,824 to 13,838 feet; and 500 md from 13,838 to 13,868 feet. The screen location is from 13,804 to 13,872 feet, which is a two foot overlap above and a four foot overlap below the perforations. The screen is 0.008 gauge Micro-pak with 3.071 inch outer diameter and 1.995 inch internal diameter with 20/40 Econoprop Prepack of specific gravity 2.72. The gas viscosity is 0.0215 centipoise, z factor is 0.9684, and gas compressibility factor is $1.837\times10(-4)$. The rheologic properties of the cross linked guar are: the temperature of the cross linked guar is 190 degrees Fahrenheit when n' (power loss fluid exponent) is 0.61 and the K'

(power loss fluid constant or consistency index) is 0.037 lb(f)sec(n')/(ft2); and when the temperature of the guar is 125 degrees Fahrenheit the n' is 0.82 and the K is 0.0046 lb(f)sec(n')/(ft2). The proppant schedules includes a 3,000 gallon (gal) pad, followed by 1,000 gal of 0.5 lb/gal; 800 of 2.5 lb/gal; 2,500 gal of 5.0 lb/gal; 800 gal of 7.5 lb/gal; 800 gal of 10.0 lb/gal; 800 gal of 12.5 lb/gal; and 3,000 gal of 15.0 lb/gal. The pump rate is 14 per minute.

Using the above base rheologic conditions, the following runs are completed with different combinations of washpipe size, plugged screen, rheology and screen location relative to the perforated zone. The results of the simulations are illustrated in Table 1, the axial distance zero corresponds to 13,531 feet.

TABLE 1

| Run | Case | Time Sandout occurred, seconds | Gallons pumped @ Sandout | Proppant Stage @ Sandout, lb/gal |
|---|---|---|---|---|
| 1 | no washpipe | 423 | 4,145 | 2.5 |
| 2 | 1.66 inch OD washpipe | 448 | 4,390 | 2.5 |
| 3 | 1.99 inch OD washpipe | 1,094 | 10,721 | 15 |
| 4 | 1.99 inch OD washpipe with 10× erosion coefficient | 1,084 | 10,623 | 15 |
| 5 | plugged screen | 1,109 | 10,868 | 15 |
| 6 | 1.66 inch OD washpipe with 125° F. rheology | 448 | 4,390 | 2.5 |
| 7 | main screen located 4 ft below perforations and 125° F. rheology | 1,109 | 10,868 | 15 |

Run 1 shows that with no wash pipe sand out occurs at 423 seconds.

Run 2 shows that a 1.66 inch outer diameter washpipe slightly increased the time before sandout occurred (448 seconds). However, bridging occurred very early at the top of the screen.

In Run 3, the washpipe outer diameter is increased to 1.99 inch (which is not practicable but is considered for comparison purposes) and the time to sandout increased to 1094 seconds; the job could progress partially through the 15 pound per gallon proppant stage. Bridging occurs over the perforated interval and at the top of the screen.

In Run 4, the erosion coefficient is increased ten fold and a slight decrease in the time to sandout is 1084 seconds. The bridging pattern shows more erosion of the pack near the top perforations.

In Run 5, the screen is temporarily plugged with crosslinked guar (to simulate a plugged screen which would prevent bridging on the screen), and the time to sandout is 1109 seconds; this increased to nearly 2.5 times the base case with a 1.66 inch outer diameter washpipe. This is the maximum time to sandout of the cases studied. The bridge appears to be more evenly distributed over a greater distance.

In Run 6, the rheology of the crosslinked guar is 125 degrees Fahrenheit (estimated injection temperature at 14 bpm) and a 1.66 inch OD washpipe is used. The time to sandout is the same as in Run 2 where 190 degrees Fahrenheit was used (448 seconds). In both cases, bridging occurred at the top of the screen.

Run 7, an unexpected result occurs when the top of the screen is lowered four feet below the top perforations; this gives the same maximum time to sandout (1109 seconds) as the temporary plugged screen in Run 5. In this case, the bridge formed uniformly over the top section of the perforations.

This invention describes a simple but unique method to extend the time to sandout. If the top of the screen is below the top perforations, the chances of premature bridging are dramatically reduced because the fluid can flow to the perforations or fractures rather than bridge between the casing and the screen.

While the foregoing preferred embodiments of the invention have been described and shown above, it is understood that alternatives and modifications may be made thereto by those skilled in the art and thus such modifications are intended to fall within the scope of the invention.

What is claimed is:

1. A method of frac packing a well bore penetrating a subterranean formation, wherein the well bore contains a plurality of perforations in fluid communication with hydrocarbons within the formation, comprising:

positioning in the well bore a tubular liner that contains a plurality of apertures such that the uppermost aperture in said liner is below the uppermost of said plurality of perforations in the well bore and such that at least a substantial portion of the apertures in said liner juxtapose a substantial number of the perforations in the well bore;

introducing a frac pack slurry comprised of frac packing material suspended in a carrier fluid into an annulus that is defined between the liner and the well bore; and pumping said frac pack slurry at a rate such that bridging of the frac packing material does not occur at the top portion of the liner and such that the formation is fractured.

2. The method of claim 1 wherein the frac packing material is sized to not flow through the apertures of the liner.

3. The method of claim 1 wherein a temporary plugging agent is used to block flow through a substantial number of the apertures in the upper portion of the liner.

4. The method of claim 1 wherein the well bore extends at an angle to the vertical.

5. The method of claim 1 wherein the top of the liner is about ½ to about 15 feet below the top of the perforations.

6. The method of claim 1 wherein the top of the liner is about 1 to about 8 feet below the top of the perforations.

7. The method of claim 1 wherein the frac pack slurry is pumped at a rate of about 2 to about 50 bpm.

8. The method of claim 1 wherein the perforated portion of the formation has a density of about 2 to about 16 perforations per foot.

9. The method of claim 1 wherein there are sufficient number of perforations above the top portion of the apertures in the liner such that when pumping the frac pack slurry the frac packing material in the slurry does not bridge off at the top of the liner.

10. The method of claim 1 wherein said liner is at least partially covered by a screen having openings therethrough, said step of positioning said tubular liner further comprises positioning the top of said screen below the uppermost of said plurality of perforations in the well bore.

* * * * *